US008771591B1

(12) United States Patent
Bennett

(10) Patent No.: US 8,771,591 B1
(45) Date of Patent: Jul. 8, 2014

(54) SILVER ALLOY WITH HIGH TARNISH RESISTANCE

(75) Inventor: Charles Bennett, Costa Mesa, CA (US)

(73) Assignee: American Bullion Investment Company, Inc., Carson, CA (US)

( * ) Notice: Subject to any disclaimer, the term of this patent is extended or adjusted under 35 U.S.C. 154(b) by 0 days.

(21) Appl. No.: 12/556,461

(22) Filed: Sep. 9, 2009

(51) Int. Cl.
*C22C 5/06* (2006.01)
*C22C 5/08* (2006.01)

(52) U.S. Cl.
USPC ..... 420/503; 420/504

(58) Field of Classification Search
CPC ..... C22C 5/06; C22C 5/08
USPC ..... 420/503, 504
See application file for complete search history.

(56) References Cited

U.S. PATENT DOCUMENTS

| | | | |
|---|---|---|---|
| 4,810,308 | A | 3/1989 | Eagar et al. |
| 4,869,757 | A | 9/1989 | Eagar et al. |
| 4,973,446 | A | 11/1990 | Bernhard et al. |
| 5,037,708 | A | 8/1991 | Davitz |
| 5,039,479 | A | 8/1991 | Bernhard et al. |
| 5,171,643 | A | 12/1992 | Suzuki et al. |
| 5,558,833 | A | 9/1996 | Zamojski |
| 5,817,195 | A | 10/1998 | Davitz |
| 5,882,441 | A | 3/1999 | Davitz |
| 6,139,652 | A | 10/2000 | Carrano et al. |
| 6,168,071 | B1 | 1/2001 | Johns |
| 6,406,664 | B1 | 6/2002 | Diamond |
| 6,726,877 | B1 | 4/2004 | Eccles |
| 6,841,012 | B2 | 1/2005 | Croce |
| 6,860,949 | B1 | 3/2005 | Weber |
| 7,118,707 | B2 | 10/2006 | Robinson |
| 7,128,792 | B2 | 10/2006 | Menon |
| 7,128,871 | B2 | 10/2006 | Davitz |
| 7,198,683 | B2 | 4/2007 | Agarwal et al. |
| 2004/0219055 | A1* | 11/2004 | Croce ..... 420/504 |
| 2008/0166260 | A1 | 7/2008 | Faverjon |

FOREIGN PATENT DOCUMENTS

JP 62243725 A * 10/1987 ..... C22C 5/06

* cited by examiner

*Primary Examiner* — Rebecca Lee
(74) *Attorney, Agent, or Firm* — Knobbe Martens Olson & Bear, LLP

(57) ABSTRACT

A high tarnish resistant silver alloy composition formulated for jewelry and flatware manufacture is provided. In certain implementations, the alloy contains about 92%-97% by weight silver, about 0.25%-3.5% by weight palladium, about 0%-3.5% by weight platinum, about 0%-2.5% by weight gold, about 0.1%-1.0% by weight copper, about 0.5%-3.5% by weight zinc, about 0.1%-1.5% by weight tin, about 0.25%-1.5% by weight indium, about 0.03%-1.1% by weight silicon, about 0%-0.5% by weight germanium, about 0.15%-0.5% by weight gallium, about 0.25%-0.5% by weight cobalt and about 0%-0.5% by weight ruthenium. These unique combinations of elements result in the alloys with the tarnish resistance superior to typical 10K gold alloy.

7 Claims, 1 Drawing Sheet

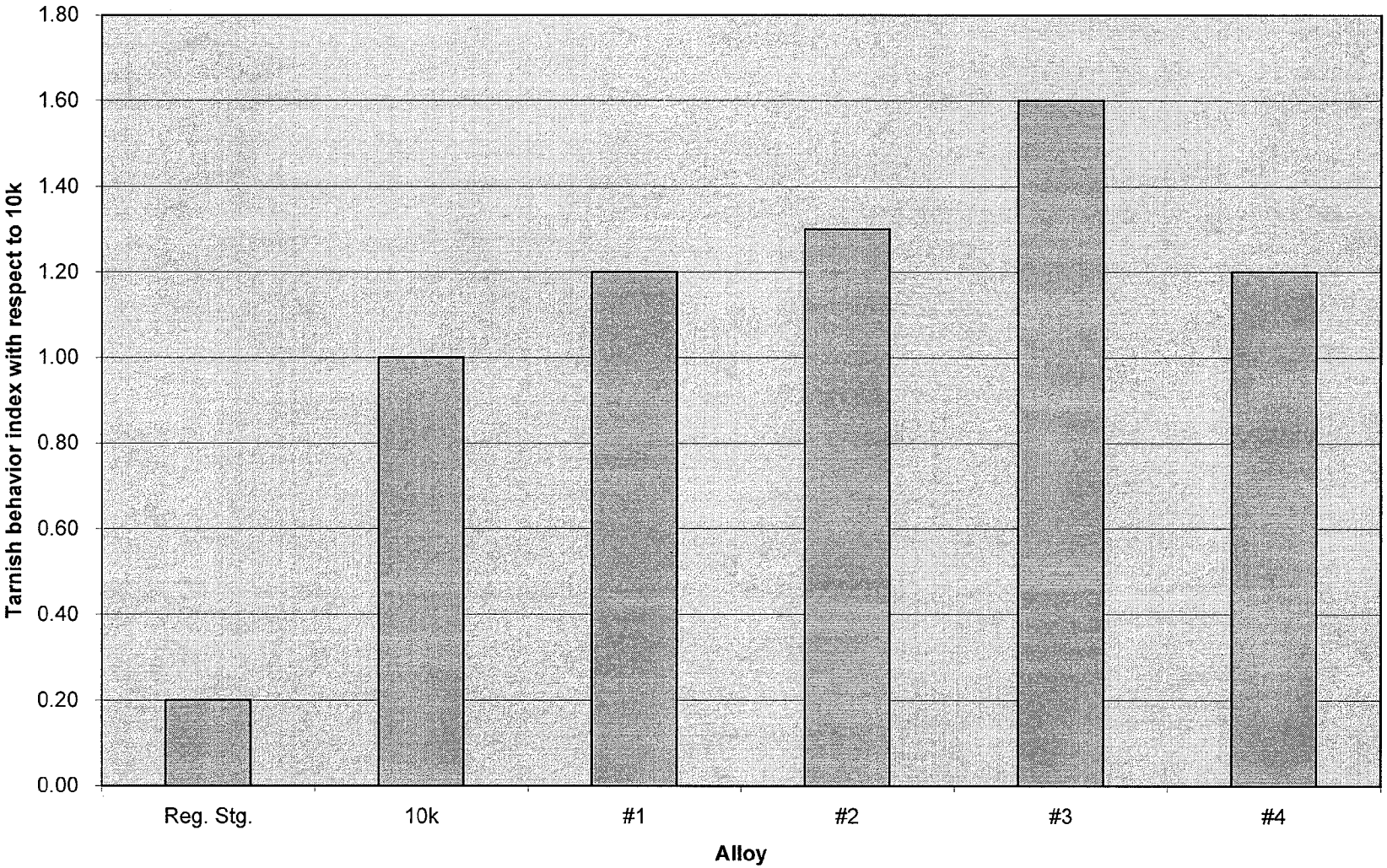
Tarnish behavior index with respect to 10k
1.80
1.60
1.40
1.20
1.00
0.80
0.60
0.40
0.20
0.00
Reg. Stg.
10k
#1
#2
#3
#4
Alloy

SILVER ALLOY WITH HIGH TARNISH RESISTANCE

BACKGROUND OF THE INVENTION

1. Field of the Invention

This invention relates generally to metal alloys, and more particularly, relates to compositions of certain silver alloy for use in jewelry, flatware, and the like.

2. Description of the Related Art

Sterling silver is commonly used for jewelry and flatware manufacturing. Classic or regular sterling typically contains about 92.5% by weight silver and 7.5% by weight copper. Its use dates back to at least as early as the $14^{th}$ Century. In modern times, sterling silver alloys may include elements other than silver and copper. However, the silver content of conventional sterling silver compositions has generally remained at 92.5% or higher.

Unlike karat gold alloys, regular sterling silver is expected to tarnish readily due to formation of copper oxides, and silver and copper sulfides. As a result, a number of different sterling silver alloys have been developed to improve the alloy's resistance to tarnishing. This is typically achieved by reducing the copper content to minimize the oxidation, and by adding some elements of oxides which serve as a protection against tarnish. While some of these silver alloys are formulated to have higher tarnish resistance than that of regular sterling silver, there is still a need for silver alloys with more improved tarnish resistance.

SUMMARY OF THE INVENTION

The preferred embodiments of the present invention provide certain improved silver alloy compositions that are formulated to ameliorate at least some of the shortcomings of prior art metal alloys. However, no single one of the disclosed compositions and parameters is solely responsible for their desirable attributes and not all of the compositions and parameters are necessary to achieve the advantages of the metal alloys of the preferred embodiments. After considering this discussion, and particularly after reading the section entitled "Detailed Description of the Preferred Embodiments," one will understand how the features of the preferred embodiments provide advantages over prior art.

The term Tarnish Behavior Index or TBI as used herein refers to the ratio between the measured exposure time of noticeable tarnish for a tested alloy (T) and the measured exposure time of noticeable tarnish for common 10K yellow gold alloy ($T_{10k}$). Therefore, in general, the values of TBI<1 describe the alloys that tarnish faster than 10K gold alloy, the TBI=1 describes the alloys that tarnish at the same rate as 10K gold alloy, and values of TBI>1 describe the alloys that show better than 10K gold alloy tarnish behavior.

In one embodiment, the alloy composition consists essentially of about 92%-97% by weight silver, about 0.25%-1% by weight palladium, 0%-0.5% by weight platinum, about 0%-0.5% by weight gold, about 0.4%-0.45% by weight copper, about 1.45%-2.75% by weight zinc, about 0.1%-0.35% by weight tin, about 0.85%-1% by weight indium, about 0.05% by weight silicon, about 0%-0.35% germanium, about 0.2%-0.25% by weight gallium, about 0.2%-0.25% by weight cobalt, and about 0-0.05% ruthenium. Preferably, the tarnish behavior index of the alloy with respect to 10K gold alloy is greater than or equal to 1.4. In some implementations, the tarnish behavior index of the alloy with respect to 10K gold alloy is preferably between about 1.2 to 1.6.

In another embodiment, the alloy composition consists essentially of about 95% by weight silver, about 0.25% by weight palladium, about 0.4% by weight copper, about 2.75% by weight zinc, about 0.1% by weight tin, about 1% by weight indium, about 0.05% by weight silicon, about 0.2% by weight gallium, and about 0.25% by weight cobalt.

In yet another embodiment, the alloy composition consists essentially of about 95% by weight silver, about 1% by weight palladium, about 0.45% by weight copper, about 1.45% by weight zinc, about 0.35% by weight tin, about 0.9% by weight indium, about 0.05% by weight silicon, about 0.35% by weight germanium, about 0.2% by weight gallium, and about 0.25% by weight cobalt.

In yet another embodiment, the alloy composition consists essentially of about 95% by weight silver, about 1% by weight palladium, about 0.5% by weight gold, about 0.45% by weight copper, about 1.55% by weight zinc, about 0.1% by weight tin, about 0.85% by weight indium, about 0.05% by weight silicon, about 0.25% by weight gallium, and about 0.25% by weight cobalt.

In yet another embodiment, the alloy composition consists essentially of about 95% by weight silver, about 0.5% by weight palladium, about 0.5% by weight platinum, about 0.5% by weight gold, about 0.45% by weight copper, about 1.55% by weight zinc, about 0.1% by weight tin, about 0.85% by weight indium, about 0.05% by weight silicon, about 0.25% by weight gallium, about 0.2% by weight cobalt, and about 0.05% by weight ruthenium.

In yet another embodiment, the alloy composition consists essentially of about 92%-97% by weight silver, about 0.25%-3.5% by weight palladium, about 0%-3.5% by weight platinum, about 0%-2.5% by weight gold, about 0.1%-1% by weight copper, about 0.5%-3.5% by weight zinc, about 0.1%-1.5% by weight tin, about 0.25%-1.5% by weight indium, about 0.03%-1.1% by weight silicon, about 0%-0.5% germanium, about 0.15%-0.5% by weight gallium, about 0.25%-0.5% by weight cobalt, and about 0-0.5% ruthenium.

In yet another embodiment, the alloy composition consists essentially of about 95% by weight silver, about 0.25% by weight palladium, about 0.4% by weight copper, about 2.1% by weight zinc, about 0.3% by weight tin, about 1.1% by weight indium, about 0.05% by weight silicon, about 0.35% by weight germanium, about 0.2% by weight gallium, and about 0.25% by weight cobalt.

In yet another embodiment, the alloy composition consists essentially of about 95% by weight silver, about 1% by weight palladium, about 0.45% by weight copper, about 1.45% by weight zinc, about 0.35% by weight tin, about 0.9% by weight indium, about 0.05% by weight silicon, about 0.35% by weight germanium, about 0.2% by weight gallium, and about 0.25% by weight cobalt.

In yet another embodiment, the alloy composition consists essentially of about 95% by weight silver, about 1% by weight palladium, about 0.5% by weight gold, about 0.45% by weight copper, about 1.15% by weight zinc, about 0.15% by weight tin, about 0.95% by weight indium, about 0.05% by weight silicon, about 0.25% by weight germanium, about 0.25% by weight gallium, and about 0.25% by weight cobalt.

In yet another embodiment, the alloy composition consists essentially of about 95% by weight silver, about 0.5% by weight palladium, about 0.5% by weight platinum, about 0.5% by weight gold, about 0.45% by weight copper, about 1.15% by weight zinc, about 0.15% by weight tin, about 0.95% by weight indium, about 0.05% by weight silicon, about 0.25% by weight germanium, about 0.25% by weight gallium, about 0.2% by weight cobalt, and about 0.05% by weight ruthenium.

BRIEF DESCRIPTION OF THE DRAWINGS

FIG. 1 is a chart illustrating the Tarnish Behavior Index (TBI) of alloys of certain preferred embodiments with respect to 10K gold alloy.

DETAILED DESCRIPTION OF THE PREFERRED EMBODIMENTS

Embodiments of the present invention provide certain silver alloys that are formulated with high tarnish resistance. The compositions are designed to create a cost effective silver alloy having the advantageous properties associated with sterling silver and yet high tarnish resistance. Preferably, the silver alloys have greater tarnish resistance than regular sterling silver. In some preferred embodiments, the silver alloys have greater tarnish resistance than even 10K gold alloy.

In one preferred embodiment, the composition of the alloy comprises about 92%-97% by weight silver, about 0.25%-3.5% by weight palladium, about 0%-3.5% by weight platinum, about 0%-2.5% by weight gold, about 0.1%-1.0% by weight copper, about 0.5%-3.5% by weight zinc, about 0.1%-1.5% by weight tin, about 0.25%-1.5% by weight indium, about 0.03%-1.1% by weight silicon, about 0%-0.5% by weight germanium, about 0.15%-0.5% by weight gallium, about 0.25%-0.5% by weight cobalt and about 0%-0.5% by weight ruthenium. These unique combinations of elements result in the alloys with the tarnish resistance superior to typical 10K yellow alloy.

Four alloy compositions of preferred embodiments were prepared in accordance with methods known in the art and tested for tarnish behavior with respect to 10K gold alloy. The compositions of each alloy are illustrated in Table 1.

TABLE 1

Alloys of preferred embodiment.

| Element concentration w % | Alloy 1 | Alloy 2 | Alloy 3 | Alloy 4 |
|---|---|---|---|---|
| w % Ag | 95 | 95 | 95 | 95 |
| w % Pd | 0.25 | 1 | 1 | 0.5 |
| w % Pt | 0 | 0 | 0 | 0.5 |
| w % Au | 0 | 0 | 0.5 | 0.5 |
| w % Cu | 0.40 | 0.45 | 0.45 | 0.45 |
| w % Zn | 2.75 | 1.45 | 1.55 | 1.55 |
| w % Sn | 0.1 | 0.35 | 0.1 | 0.1 |
| w % In | 1 | 0.9 | 0.85 | 0.85 |
| w % Si | 0.05 | 0.05 | 0.05 | 0.05 |
| w % Ge | 0 | 0.35 | 0 | 0 |
| w % Ga | 0.2 | 0.2 | 0.25 | 0.25 |
| w % Co | 0.25 | 0.25 | 0.25 | 0.2 |
| w % Ru | 0 | 0 | 0 | 0.05 |

As shown in Table 1, Alloy No. 1 contains about 95% by weight silver, about 0.25% by weight palladium, about 0.4% by weight copper, about 2.75% by weight zinc, about 0.1% by weigh tin, about 1% by weight indium, about 0.05% by weight silicon, about 0.2% by weight gallium and about 0.25% by weight cobalt.

Alloy No. 2 contains about 95% by weight silver, about 1% by weight palladium, about 0.45% by weight copper, about 1.45% by weight zinc, about 0.35% by weight tin, about 0.9% by weight indium, about 0.05% by weight silicon, about 0.35% by weight germanium, about 0.2% by weight gallium and about 0.25% by weight cobalt.

Alloy No. 3 contains about 95% by weight silver, about 1% by weight palladium, about 0.5% by weight gold, about 0.45% by weight copper, about 1.55% by weight zinc, about 0.1% by weight tin, about 0.85% by weight indium, about 0.05% by weight silicon, about 0.25% by weight gallium, and about 0.25% by weight cobalt.

Alloy No. 4 contains about 95% by weight silver, about 0.5% by weight palladium, about 0.5% by weight platinum, about 0.5% by weight gold, about 0.45% by weight copper, about 1.55% by weight zinc, about 0.1% by weight tin, about 0.85% by weight indium, about 0.05% by weight silicon, about 0.25% by weight gallium, about 0.2% by weight cobalt and about 0.05% by weight ruthenium.

The tarnish behavior of Alloys No. 1 through No. 4 were tested against regular sterling silver alloy and common 10K yellow gold alloys using methods known in the art. In this tarnish test, polished cast ring samples of each alloy were prepared and exposed to a vapor of liquid solution of liver of sulfur. The exposure time in minutes after which the tarnish became visually noticeable was recorded for reach alloy, and then the tarnish behavior index (TBI) was calculated for each alloy in respect to 10K gold alloy using the following formula:

$$TBI=T/T_{10K},$$

where T is the measured exposure time of noticeable tarnish for a tested alloy, and $T_{10K}$ is the measured exposure time of noticeable tarnish for common 10K yellow gold alloy.

Therefore, in general, the values of TBI<1 describe the alloys that tarnish faster than 10K, the TBI=1 describes the alloys that tarnish at the same rate as 10K, and values of TBI>1 describe the alloys that show better than 10K tarnish behavior.

Table 2 lists the average TBI value for Alloys Nos. 1, 2, 3 and 4. Each value represents average TBI values of five independent tests.

TABLE 2

| Alloy | TBI (Tarnish Behavior Index) |
|---|---|
| Regular sterling silver | 0.2 |
| Common 10K yellow | 1 |
| #1 | 1.2 |
| #2 | 1.3 |
| #3 | 1.6 |
| #4 | 1.2 |

As shown in Table 2, sterling silver tarnishes approximately 5 times faster that 10K yellow gold alloy. Alloys Nos. 1, 2, 3, and 4 all show improved tarnish behavior in comparison to regular sterling. In fact, Alloys Nos. 1, 2, 3, and 4 show about 1.2-1.6 times better tarnish behavior than 10K yellow gold alloy. This data is also illustrated by the chart shown in FIG. 1.

Table 3 illustrates silver alloy compositions of certain other preferred embodiments which also exhibit high tarnish resistant properties. Alloys manufactured with these compositions exhibit higher tarnish resistance than that of regular sterling silver. In some embodiments, the alloys also exhibit higher tarnish resistance than that of 10K yellow gold alloy.

TABLE 3

| Element concentration w % | Alloy 5 | Alloy 6 | Alloy 7 | Alloy 8 |
|---|---|---|---|---|
| w % Ag | 95 | 95 | 95 | 95 |
| w % Pd | 0.25 | 1 | 1 | 0.5 |
| w % Pt | 0 | 0 | 0 | 0.5 |

TABLE 3-continued

| Element concentration w % | Alloy 5 | Alloy 6 | Alloy 7 | Alloy 8 |
|---|---|---|---|---|
| w % Au | 0 | 0 | 0.5 | 0.5 |
| w % Cu | 0.40 | 0.45 | 0.45 | 0.45 |
| w % Zn | 2.10 | 1.45 | 1.15 | 1.15 |
| w % Sn | 0.30 | 0.35 | 0.15 | 0.15 |
| w % In | 1.10 | 0.9 | 0.95 | 0.95 |
| w % Si | 0.05 | 0.05 | 0.05 | 0.05 |
| w % Ge | 0.35 | 0.35 | 0.25 | 0.25 |
| w % Ga | 0.2 | 0.2 | 0.25 | 0.25 |
| w % Co | 0.25 | 0.25 | 0.25 | 0.2 |
| w % Ru | 0 | 0 | 0 | 0.05 |

As shown in Table 3, Alloy No. 5 contains about 95% by weight silver, about 0.25% by weight palladium, about 0.4% by weight copper, about 2.1% by weight zinc, about 0.3% by weigh tin, about 1.1% by weight indium, about 0.05% by weight silicon, about 0.35% by weight germanium, about 0.2% by weight gallium and about 0.25% by weight cobalt.

Alloy No. 6 contains about 95% by weight silver, about 1% by weight palladium, about 0.45% by weight copper, about 1.45% by weight zinc, about 0.35% by weight tin, about 0.9% by weight indium, about 0.05% by weight silicon, about 0.35% by weight germanium, about 0.2% by weight gallium and about 0.25% by weight cobalt.

Alloy No. 7 contains about 95% by weight silver, about 1% by weight palladium, about 0.5% by weight gold, about 0.45% by weight copper, about 1.15% by weight zinc, about 0.15% by weight tin, about 0.95% by weight indium, about 0.05% by weight silicon, about 0.25% by weight germanium, about 0.25% by weight gallium, and about 0.25% by weight cobalt.

Alloy No. 8 contains about 95% by weight silver, about 0.5% by weight palladium, about 0.5% by weight platinum, about 0.5% by weight gold, about 0.45% by weight copper, about 1.15% by weight zinc, about 0.15% by weight tin, about 0.95% by weight indium, about 0.05% by weight silicon, about 0.25% by weight gallium, about 0.2% by weight cobalt and about 0.05% by weight ruthenium.

Although the foregoing description of the preferred embodiments of the present invention has shown, described and pointed out the fundamental novel features of the invention, it will be understood that various omissions, substitutions, and changes in the form of the details of the invention as illustrated as well the uses thereof, may be made by those skilled in the art, without departing from the spirit of the invention. Consequently, the scope of the invention should not be limited to the foregoing discussions.

What is claimed is:

1. An alloy composition consisting essentially of about 95% by weight silver, about 0.25% by weight palladium, about 0.4% by weight copper, about 2.75% by weight zinc, about 0.1% by weight tin, about 1% by weight indium, about 0.05% by weight silicon, about 0.2% by weight gallium, and about 0.25% by weight cobalt.

2. An alloy composition consisting essentially of about 95% by weight silver, about 1% by weight palladium, about 0.45% by weight copper, about 1.45% by weight zinc, about 0.35% by weight tin, about 0.9% by weight indium, about 0.05% by weight silicon, about 0.35% by weight germanium, about 0.2% by weight gallium, and about 0.25% by weight cobalt.

3. An alloy composition consisting essentially of about 95% by weight silver, about 1% by weight palladium, about 0.5% by weight gold, about 0.45% by weight copper, about 1.55% by weight zinc, about 0.1% by weight tin, about 0.85% by weight indium, about 0.05% by weight silicon, about 0.25% by weight gallium, and about 0.25% by weight cobalt.

4. An alloy composition consisting essentially of about 95% by weight silver, about 0.5% by weight palladium, about 0.5% by weight platinum, about 0.5% by weight gold, about 0.45% by weight copper, about 1.55% by weight zinc, about 0.1% by weight tin, about 0.85% by weight indium, about 0.05% by weight silicon, about 0.25% by weight gallium, about 0.2% by weight cobalt, and about 0.05% by weight ruthenium.

5. The alloy composition of claim 2, wherein the tarnish behavior index of the alloy with respect to 10K gold alloy is greater than or equal to about 1.4.

6. The alloy composition of claim 2, wherein the tarnish behavior index of the alloy with respect to 10K gold alloy is between about 1.2 to 1.6.

7. An alloy composition consisting essentially of about 92%-97% by weight silver, about 0.25%-1% by weight palladium, 0%-0.5% by weight platinum, about 0%-0.5% by weight gold, about 0.4%-0.45% by weight copper, about 1.15%-2.75% by weight zinc, about 0.1%-0.35% by weight tin, about 0.85%-1% by weight indium, about 0.05% by weight silicon, about 0.25%-0.5% by weight germanium, about 0.2%-0.25% by weight gallium, about 0.2%-0.25% by weight cobalt, and about 0-0.05% ruthenium.

* * * * *